US012352471B2

(12) United States Patent
Liu et al.

(10) Patent No.: US 12,352,471 B2
(45) Date of Patent: Jul. 8, 2025

(54) ZERO-LOAD OUTPUT NON-STOP CONTROL METHOD AND APPARATUS, AND UNIT

(71) Applicant: GREE ELECTRIC APPLIANCES, INC. OF ZHUHAI, Qianshan Zhuhai (CN)

(72) Inventors: Hua Liu, Zhuhai (CN); Zhiping Zhang, Zhuhai (CN); Zhongkeng Long, Zhuhai (CN); Zhiliang Luo, Zhuhai (CN); Bing Zhang, Zhuhai (CN); Mingzhi Zhao, Zhuhai (CN)

(73) Assignee: GREE ELECTRIC APPLIANCES, INC. OF ZHUHAI, Zhuhai (CN)

( * ) Notice: Subject to any disclaimer, the term of this patent is extended or adjusted under 35 U.S.C. 154(b) by 724 days.

(21) Appl. No.: 17/627,046

(22) PCT Filed: Dec. 24, 2019

(86) PCT No.: PCT/CN2019/128064
§ 371 (c)(1),
(2) Date: Jan. 13, 2022

(87) PCT Pub. No.: WO2021/051699
PCT Pub. Date: Mar. 25, 2021

(65) Prior Publication Data

US 2022/0275974 A1 Sep. 1, 2022

(30) Foreign Application Priority Data

Sep. 16, 2019 (CN) ..... 201910871922.2

(51) Int. Cl.
*F25B 1/047* (2006.01)
*F25B 41/20* (2021.01)
*F25B 41/31* (2021.01)

(52) U.S. Cl.
CPC ..... *F25B 1/047* (2013.01); *F25B 41/20* (2021.01); *F25B 41/31* (2021.01); *F25B 2600/2513* (2013.01)

(58) Field of Classification Search
CPC ..... F25B 1/047; F25B 41/31; F25B 41/20; F25B 2600/2513
(Continued)

(56) References Cited

U.S. PATENT DOCUMENTS 4,694,660 A * 9/1987 Gannaway ..... B60H 1/3216 62/197
5,596,878 A * 1/1997 Hanson ..... B60H 1/00007 62/238.7
(Continued)

FOREIGN PATENT DOCUMENTS

CN 201844626 U 5/2011
CN 202869095 U 4/2013
(Continued)

OTHER PUBLICATIONS

International Search Report mailed Jun. 11, 2020, issued in corresponding International Application No. PCT/CN2019/128064, filed Dec. 24, 2019, 3 pages.

*Primary Examiner* — Joel M Attey
(74) *Attorney, Agent, or Firm* — Christensen O'Connor Johnson Kindness PLLC

(57) ABSTRACT

Disclosed in the present invention are a zero-load output non-stop control method and apparatus, and a unit. The apparatus comprises: a three-way valve, provided at an exhaust port of a compressor; a mixing tank, provided between an air suction port of the compressor and a condenser and used for mixing a refrigerant discharged by the compressor with a refrigerant throttled by the condenser; a first electronic expansion valve, provided on a first pipeline from the condenser to the mixing tank and sued for con-
(Continued)

trolling the amount of the refrigerant throttled by the condenser and entering the mixing tank; and an electromagnetic valve, provided on a second pipeline between the three-way valve and the mixing tank and used for controlling the amount of the refrigerant discharged by the compressor and directly entering the mixing tank.

10 Claims, 1 Drawing Sheet

(58) Field of Classification Search
USPC ..... 62/117
See application file for complete search history.

(56) References Cited

U.S. PATENT DOCUMENTS

| | | | | |
|---|---|---|---|---|
| 5,603,227 | A * | 2/1997 | Holden | F25B 31/002 62/193 |
| 2010/0199694 | A1* | 8/2010 | Taras | F25B 1/10 62/513 |
| 2012/0324911 | A1* | 12/2012 | Shedd | F25B 41/00 62/62 |
| 2015/0191182 | A1* | 7/2015 | Abou Eid | F25D 21/06 62/335 |

FOREIGN PATENT DOCUMENTS

| | | | |
|---|---|---|---|
| CN | 104713274 | A | 6/2015 |
| CN | 104848620 | A | 8/2015 |
| CN | 105910229 | A | 8/2016 |
| CN | 206488498 | U | 9/2017 |
| CN | 109631376 | A | 4/2019 |
| CN | 109915952 | A | 6/2019 |
| IN | 110530075 | A | 12/2019 |
| JP | 2010236830 | A | 10/2010 |
| KR | 100575223 | B1 | 5/2006 |

* cited by examiner

ZERO-LOAD OUTPUT NON-STOP CONTROL METHOD AND APPARATUS, AND UNIT

CROSS REFERENCES TO RELATED APPLICATION

This application is a National Stage of International Application No. PCT/CN2019/128064, filed Dec. 24, 2019, which claims priority to Chinese patent application No. 201910871922.2, titled "Zero-Load Output Non-Stop Control Method and Apparatus, and Unit", and filed on Sep. 16, 2019, the contents of which are hereby incorporated by reference in their entirety.

TECHNICAL FIELD

The present disclosure relates to the field of unit technology, and particularly to a zero-load output non-stop control method and apparatus, and a unit.

BACKGROUND

In some technologies learned by the inventors, the fixed-frequency screw unit is limited to a slide valve control and can only achieve a minimum 25% load. If the load is less than 25%, the conventional fixed frequency screw unit cannot be implemented. Under the background of many industrial requirements, the unit is required to operate at 0% load without shutting down, which is equivalent to the standby process without stopping.

However, the minimum adjustable range of the screw unit through the compressor itself is 10%, which does not achieve the effect of non-stop operation under the condition of 0% output.

As for the problem that the screw unit cannot achieve the effect of zero-load output without stopping, no effective solution has been proposed at present.

SUMMARY

The embodiments of the present disclosure provide a zero-load output non-stop control method and device, and a unit, to solve the problem in the prior art that the screw unit cannot implement the zero-load output without shutting down.

In order to solve the above technical problem, the present disclosure provides a load control device, including:

- a three-way valve, provided at an exhaust outlet of a compressor;
- a mixing tank, provided between a suction inlet of the compressor and a condenser, and configured to mix refrigerant discharged from the compressor with refrigerant throttled through the condenser;
- a first electronic expansion valve, provided on a first pipeline between the condenser and the mixing tank, and configured to control an amount of the refrigerant throttled by the condenser and entering the mixing tank;
- an electromagnetic valve, provided on a second pipeline between the three-way valve and the mixing tank, and configured to control an amount of the refrigerant discharged from the compressor and directly entering the mixing tank.

Furthermore, the device further includes: a second electronic expansion valve, provided between the condenser and an evaporator, and configured to control an amount of refrigerant throttled by the condenser and entering the evaporator.

Furthermore, the device further includes: a controller, configured to control actions of the first electronic expansion valve, the second electronic expansion valve and the electromagnetic valve according to a target load of a unit and a minimum adjustable load of the compressor.

The present disclosure provides a load control method, applied to the above-mentioned load control device, the method includes: comparing a target load of a unit to a minimum adjustable load of the compressor; controlling ON or OFF of the first electronic expansion valve, the second electronic expansion valve and the electromagnetic valve according to a comparison result; the first electronic expansion valve is provided on the first pipeline between the condenser and the mixing tank, and the second electronic expansion valve is provided between the condenser and the evaporator, and the electromagnetic valve is provided on the second pipeline between the compressor and the mixing tank.

Furthermore, the controlling the ON or OFF of the first electronic expansion valve, the second electronic expansion valve and the electromagnetic valve according to the comparison result includes: when the target load of the unit is greater than the minimum adjustable load of the compressor, controlling the first electronic expansion valve to switch off, the second electronic expansion valve to operate normally, and the electromagnetic valve to switch off.

Furthermore, the controlling the ON or OFF of the first electronic expansion valve, the second electronic expansion valve and the electromagnetic valve according to the comparison result includes: when the target load of the unit is less than or equal to the minimum adjustable load of the compressor, controlling the first electronic expansion valve and the second electronic expansion valve to fully switch on, and the electromagnetic valve to switch off.

Furthermore, the controlling the ON or OFF of the first electronic expansion valve, the second electronic expansion valve and the electromagnetic valve according to the comparison result includes: when the target load of the unit is less than or equal to the minimum adjustable load of the compressor for a preset duration, controlling the electromagnetic valve to switch on, the second electronic expansion valve to switch off, and controlling an opening degree of the first electronic expansion valve according to an operating parameter.

Furthermore, the operating parameter includes at least one of: a discharge temperature of the compressor, a liquid level in the mixing tank, or a temperature in the mixing tank;

- the controlling the opening degree of the first electronic expansion valve according to the operating parameter comprises:
- when the discharge temperature of the compressor exceeds a preset temperature, controlling the first electronic expansion valve to increase a preset opening degree in unit time;
- when a degree of superheat is less than 0, controlling the first electronic expansion valve to decrease the preset opening degree in the unit time; wherein, the degree of superheat=the temperature in the mixing tank−a temperature corresponding to a saturation pressure;
- when the liquid level in the mixing tank−a preset liquid level≤0, controlling the first electronic expansion valve to decrease the preset opening degree in the unit time.

Furthermore, the controlling the opening degree of the first electronic expansion valve according to the operating parameter includes: controlling the opening degree of the first electronic expansion valve in a linkage mode according to a priority of the operating parameter; wherein the priority of the operating parameter from high to low is: the discharge temperature of the compressor, the liquid level in the mixing tank, the temperature in the mixing tank.

Furthermore, the method further includes: before controlling the electromagnetic valve to switch on, the second electronic expansion valve to switch off, and controlling the opening degree of the first electronic expansion valve according to the operating parameter, reducing a load of the compressor to a minimum when receiving a zero-load operation signal.

The present disclosure further provides a water-cooled screw unit, including the above-mentioned load control device.

The present disclosure further provides a computer-readable storage medium, storing a computer program, the program, when executed by a processor, implements the above-mentioned method.

By applying the technical solution of the present disclosure, zero-load output of the unit is implemented without shutting down, so that the unit is always in a standby state, and the shortest time response can be achieved, and the reliability can be improved. Thereby, shortening the conventional standby and restart time of the unit, and reducing fatigue caused by repeated start and stop of the motor, and increasing the service life. Accordingly, the response speed of the unit to the terminal is improved, and the risk of lowering the oil temperature in the standby state is reduced.

DETAILED DESCRIPTION

In order to make the purpose, technical solution, and advantages of the present disclosure clearer, the present disclosure will be further described in detail below with reference to the accompanying drawings. Obviously, the described embodiments are only some embodiments of the present disclosure, rather than all the embodiments. Based on the embodiments in the present disclosure, all other embodiments obtained by a person of ordinary skill in the art without creative work shall fall within the protection scope of the present disclosure.

The terms used in the embodiments of the present disclosure are only for the purpose of describing specific embodiments, and are not intended to limit the present disclosure. The singular forms of "a", "the" and "said" used in the embodiments and the appended claims of the present disclosure are also intended to include plural forms, unless the context clearly indicates other meanings, the wording "multiple" generally contains at least two.

It should be understood that the term "and/or" used in this disclosure is only an association relationship describing associated objects, indicating that there can be three types of relationships, for example, A and/or B can include three conditions, respectively single A, A and B, and single B. In addition, the character "/" in this text generally indicates that the associated objects are in an "or" relationship.

Depending on the context, the words "if" and "as if" as used herein can be interpreted as "when" or "while" or "in response to determination" or "in response to detection". Similarly, depending on the context, the phrase "if determined" or "if detected (statement or event)" can be interpreted as "when determined" or "in response to determination" or "when detected (statement or event)" or "in response to detection (statement or event)".

It should also be noted that the terms "include", "comprise" or any other variants thereof are intended to cover non-exclusive inclusion, so that a commodity or device including a series of elements not only includes those elements, but also includes other elements that are not explicitly listed, or also include elements inherent to this commodity or device. If there are no more restrictions, the element defined by the sentence "including a . . . " does not exclude the existence of other identical elements in the commodity or device that includes the element.

The optional embodiments of the present disclosure will be described in detail below with reference to the accompanying drawings.

EXAMPLE I

Figure 1:
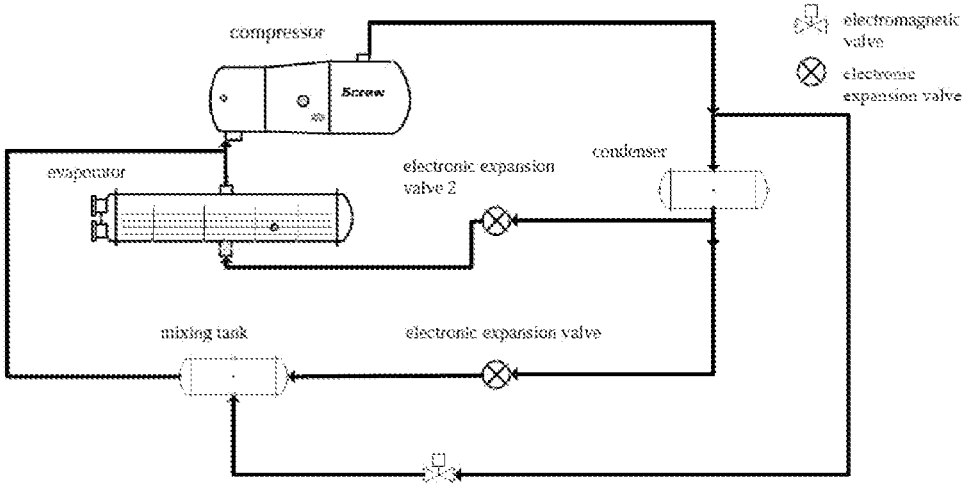
FIG. 1 is a schematic structure diagram of a load control apparatus according to an embodiment of the present disclosure.

In this embodiment, in order to implement the zero-load output of the unit without shutting down, structural improvements are made. As shown in FIG. 1, which is a schematic structure diagram of a load control device, a three-way valve is added at an exhaust outlet of a compressor, and the gas is divided into two ways. One way of the gas enters a condenser and then is throttled to a mixing tank; and the other way of the gas enters the mixing tank through electromagnetic valve control.

The mixing tank is provided between the suction inlet of the compressor and the condenser, and is configured to mix the refrigerant discharged from the compressor with the refrigerant throttled through the condenser. The first electronic expansion valve is provided on a first pipeline between the condenser and the mixing tank, and is configured to control the amount of the refrigerant throttled by the condenser into the mixing tank. The electromagnetic valve is provided on a second pipeline between the three-way valve and the mixing tank, and is configured to control the amount of the refrigerant discharged from the compressor and directly entering the mixing tank. The second electronic expansion valve is provided between the condenser and an evaporator, and is configured to control the amount of the refrigerant throttled by the condenser and entering the evaporator.

When the unit operates, a bypass pipeline matching a displacement of the unit is utilized according to different displacement of the unit. An electromagnetic valve is added to the bypass pipeline to control the on and off of the pipeline. For the above-mentioned control logic, this embodiment also includes a controller which is configured to control actions of the first electronic expansion valve, the second electronic expansion valve and the electromagnetic valve according to a target load of a unit and a minimum adjustable load of the compressor. Based on this, the unit can implement the stable and reliable operation under zero load by controlling the pipeline electromagnetic valve and the electronic expansion valve.

This embodiment also provides a water-cooled screw unit including the load control device described above, to implement the zero-load output without shutting down.

EXAMPLE II

Figure 2:
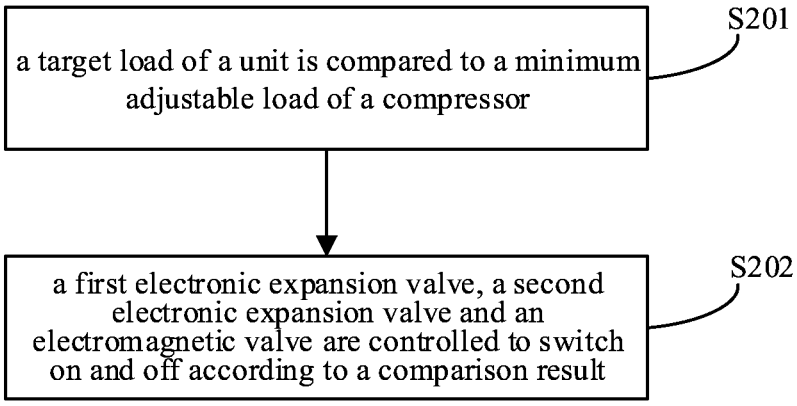
FIG. 2 is a flow chart showing a load control method according to an embodiment of the present disclosure.

Based on the above-mentioned improved structure, this embodiment provides a load control method, which is applied to the load control device described above, as shown in the flow chart of the load control method in FIG. 2, the method includes:

Step S201: a target load of a unit is compared to a minimum adjustable load of a compressor;

Step S202: a first electronic expansion valve, a second electronic expansion valve and an electromagnetic valve are controlled to switch on and off according to a comparison result.

The first electronic expansion valve is provided on the first pipeline between the condenser and the mixing tank; the second electronic expansion valve is provided between the condenser and the evaporator; and the electromagnetic valve is provided on the second pipeline between the compressor and the mixing tank. The specific structure is described in detail above and will not be repeated here.

In this embodiment, the comparison results of the target load of the unit and the minimum adjustable load of the compressor can be summarized as two types.

The first type is that, when the target load of the unit is greater than the minimum adjustable load of the compressor, the first electronic expansion valve is controlled to switch off, the second electronic expansion valve operates normally, and the electromagnetic valve is controlled to switch off. In addition, if the unit receives a signal for non-zero load operation, the unit also controls the first electronic expansion valve to switch off, the second electronic expansion valve to operate normally, and the electromagnetic valve to switch off. That is, all the refrigerant throttled by the condenser enters the evaporator, and the unit can operate normally.

The second type is that, if the target load of the unit is less than or equal to the minimum adjustable load of the compressor, the first electronic expansion valve and the second electromagnetic value are controlled to fully switch on, and the electromagnetic valve is controlled to switch off. That is, part of the refrigerant throttled through the condenser directly enters the evaporator, while the other part enters the mixing tank and then directly returns to the compressor without passing through the evaporator.

In this case, further, if the target load of the unit is less than or equal to the minimum adjustable load of the compressor, and after a preset period of time, the electromagnetic valve is controlled to switch on, the second electronic expansion valve is controlled to switch off, and an opening degree of the first electronic expansion valve is controlled according to an operating parameter. In addition, if a zero-load operation signal is received, the load of the compressor load is reduced to the minimum, and then the electromagnetic valve is controlled to switch on, the second electronic expansion valve is controlled to switch off, and the opening degree of the first electronic expansion valve is controlled according to the operating parameter.

Specifically, the aforementioned operating parameter includes at least one of the following: a discharge temperature of the compressor, a liquid level in the mixing tank, and a temperature in the mixing tank. When the discharge temperature of the compressor exceeds a preset temperature, the first electronic expansion valve is controlled to increase a preset opening degree within unit time. When a degree of superheat is less than 0, the first electronic expansion valve is controlled to decrease the preset opening degree within the unit time; here the degree of superheat is equal to the temperature in the mixing tank minus a temperature corresponding to a saturation pressure. When the liquid level in the mixing tank minus the preset liquid level is less than or equal to 0, the first electronic expansion valve is controlled to reduce the preset opening degree within the unit time. Based on this, the pressure of the refrigerant entering the compressor can be controlled.

Of course, in the specific implementation, the opening degree of the first electronic expansion valve can be controlled in a linkage mode according to a priority of the operating parameter. The priority of the operating parameter can be set from high to low as: the discharge temperature of the compressor, the liquid level in the mixing tank, the temperature in the mixing tank.

It should be noted that in this embodiment, the switching on of the electromagnetic valve can control a part of the refrigerant not to pass through the condenser. By mixing with the throttled refrigerant in the mixing tank, the compressor can operate normally under the minimum load. The first electronic expansion valve is adjusted to make the amount of the refrigerant passing through the main liquid pipe offset the amount of the bypass refrigerant, thereby effectively balancing the system and achieving the effect of non-stop operation of the compressor. If the refrigerant only passes through the mixing tank without passing through the evaporator, the unit does not refrigerate to the outside, thereby implementing the purpose of zero-load output.

EXAMPLE III

This embodiment introduces the control logic for implementing the zero-load output with non-stopping.

1) When the target load of the unit is greater than the minimum adjustable load of the compressor, the electromagnetic valve is controlled to switch off, the first electronic expansion valve (electronic expansion valve 1) is controlled to switch off, and the second electronic expansion valve (electronic expansion valve 2) is controlled to operate normally.
2) When the target load of the unit is less than or equal to the minimum adjustable load of the compressor, the electromagnetic valve is controlled to switch off, and the first electronic expansion valve and the second electronic expansion valve are controlled to switch on with the opening degree of 100%.
3) When the target load of the unit is less than the minimum adjustable load of the compressor, and this condition continues for a preset duration (for example, 5 min), the electromagnetic valve is controlled to switch on, the second electronic expansion valve is controlled to switch off, and the first electronic expansion valve is automatically adjusted. Specifically, by comparing the pressure, temperature, and liquid level in the mixing tank with the set values, the pressure of the refrigerant entering the compressor is controlled.

Specifically, the adjustment mode of the first electronic expansion valve is as follows:

a. if a difference value of the liquid level=an actual height of the liquid level−a set height of the liquid level≤0, the electronic expansion valve is controlled to switch off by X%/T;
b. if the degree of superheat=the temperature−the temperature corresponding to the saturation pressure<0, the electronic expansion valve is controlled to switch off by X%/T;
c. if the discharge temperature of the compressor>than 50° C., the electronic expansion valve is controlled to switch on by X%/T.

According to the above three linkage controls, the priority is c>a>b, X is a positive integer, T is the time, and the unit time is in seconds.

It should be noted that the unit may receive a zero-load operation signal or a non-zero load operation signal. When receiving the zero-load operation signal, the unit reduces the load of the compressor and performs 3) after reaching the minimum load. When receiving the non-zero load operation signal, the unit operates according to 1).

EXAMPLE IV

In the embodiment of the present disclosure, software is provided, which is configured to execute the technical solution described in the above-mentioned embodiments and preferred embodiments.

In the embodiment of the present disclosure, a non-transitory computer storage medium is provided, and the computer storage medium stores computer-executable instructions, and the computer-executable instructions can perform the load control method in any of the above-mentioned method embodiments. The above-mentioned storage medium stores the above-mentioned software, and the storage medium includes, but is not limited to: an optical disk, a floppy disk, a hard disk, a rewritable memory, and the like.

It can be seen from the above description that in the present disclosure, through the communication between the exhaust outlet and the suction inlet of the compressor, and when low load operation is reached, the load output is continuously reduced until zero load. By adding the electromagnetic valve and controlling the ON or OFF thereof, the control of the minimum load state is implemented. By adding the mixing tank, the two ways of refrigerant from the exhaust of the unit are mixed, and then enters the compressor again after the suction temperature and pressure are reduced. By controlling the liquid level, temperature and pressure in the mixing tank, the purpose of controlling the compressor to operate stably and reliably under a small load is achieved. In industrial applications and special fields, it is necessary to keep the unit in an operation state for a long time without any output load, and without shutting down, to achieve the purpose of reducing the time wasted in startup and shutdown.

The above-mentioned products such as the unit equipment can execute the method provided in the embodiments of the present disclosure, and have the corresponding functional modules and beneficial effects for the execution method. For technical details that are not elaborated in this embodiment, reference can be made to the method provided in the embodiment of the present disclosure.

The device embodiments described above are merely illustrative, where the units described as separate components may or may not be physically separated, and the components displayed as units may or may not be physical units, that is, they may be located in one place, or can be distributed to multiple network units. Some or all of the modules can be selected according to actual requirements to achieve the purpose of the solution of the embodiments.

Through the description of the above embodiments, those skilled in the art can clearly understand that each embodiment can be implemented by means of software plus a necessary general hardware platform, and of course, can also be implemented by hardware. Based on this understanding, the above technical solution essentially or the part that contributes to the existing technology can be embodied in the form of a software product, and the computer software product can be stored in a computer-readable storage medium, such as a ROM/RAM, a magnetic disc, an optical disc, etc., including a number of instructions to make a computer device (which may be a personal computer, a server, or a network device, etc.) execute the methods described in each embodiment or some parts of the embodiment.

Finally, it should be noted that the above embodiments are only utilized to illustrate the technical solution of the present disclosure, not to limit it. Although the present disclosure has been described in detail with reference to the foregoing embodiments, those of ordinary skill in the art should understand that the technical solution recorded in the foregoing embodiments can be modified, or some of the technical features can be equivalently replaced; and these modifications or replacements do not cause the corresponding technical solution to essentially deviate from the spirit and scope of the technical solution of the embodiments of the present disclosure.

What is claimed is:

1. A load control device, comprising:

a three-way valve, provided at an exhaust outlet of a compressor;

a mixing tank, provided between a suction inlet of the compressor and a condenser, and configured to mix refrigerant discharged from the compressor with refrigerant throttled through the condenser;

a first electronic expansion valve, provided on a first pipeline between the condenser and the mixing tank, and configured to control an amount of the refrigerant throttled by the condenser and entering the mixing tank;

an electromagnetic valve, provided on a second pipeline between the three-way valve and the mixing tank, and configured to control an amount of the refrigerant discharged from the compressor and directly entering the mixing tank;

a second electronic expansion valve, provided between the condenser and an evaporator, and configured to control an amount of refrigerant throttled by the condenser and entering the evaporator; and a controller configured to:

compare a predetermined target load to a minimum adjustable load of the compressor for obtaining a comparison result;

control ON or OFF of the first electronic expansion valve, the second electronic expansion valve and the electromagnetic valve according to the comparison result;

wherein, the first electronic expansion valve is provided on the first pipeline between the condenser and the mixing tank, and the second electronic expansion valve is provided between the condenser and the evaporator, and the electromagnetic valve is provided on the second pipeline between the compressor and the mixing tank.

2. A load control method, applied to a load control device comprising:

a three-way valve, provided at an exhaust outlet of a compressor;

a mixing tank, provided between a suction inlet of the compressor and a condenser, and configured to mix refrigerant discharged from the compressor with refrigerant throttled through the condenser;

a first electronic expansion valve, provided on a first pipeline between the condenser and the mixing tank, and configured to control an amount of the refrigerant throttled by the condenser and entering the mixing tank;

an electromagnetic valve, provided on a second pipeline between the three-way valve and the mixing tank, and configured to control an amount of the refrigerant discharged from the compressor and directly entering the mixing tank; and a second electronic expansion valve, provided between the condenser and an evaporator, and configured to control an amount of refrigerant throttled by the condenser and entering the evaporator;

the method comprising:

comparing a predetermined target load to a minimum adjustable load of the compressor for obtaining a comparison result;

controlling ON or OFF of the first electronic expansion valve, the second electronic expansion valve and the electromagnetic valve according to the comparison result;

wherein, the first electronic expansion valve is provided on the first pipeline between the condenser and the mixing tank, and the second electronic expansion valve is provided between the condenser and the evaporator, and the electromagnetic valve is provided on the second pipeline between the compressor and the mixing tank.

3. The method according to claim 2, wherein the controlling the ON or OFF of the first electronic expansion valve, the second electronic expansion valve and the electromagnetic valve according to the comparison result comprises:

when the predetermined target load is greater than the minimum adjustable load of the compressor, controlling the first electronic expansion valve to switch off, the second electronic expansion valve to operate, and the electromagnetic valve to switch off.

4. The method according to claim 2, wherein the controlling the ON or OFF of the first electronic expansion valve, the second electronic expansion valve and the electromagnetic valve according to the comparison result comprises:

when the predetermined target load is less than or equal to the minimum adjustable load of the compressor, controlling the first electronic expansion valve and the second electronic expansion valve to fully switch on, and the electromagnetic valve to switch off.

5. The method according to claim 2, wherein the controlling the ON or OFF of the first electronic expansion valve, the second electronic expansion valve and the electromagnetic valve according to the comparison result comprises:

when the predetermined target load is less than or equal to the minimum adjustable load of the compressor for a predetermined duration, controlling the electromagnetic valve to switch on, the second electronic expansion valve to switch off, and controlling an opening degree of the first electronic expansion valve according to an operating parameter.

6. The method according to claim 5, wherein the operating parameter comprises at least one of: a discharge temperature of the compressor, a liquid level in the mixing tank, or a temperature in the mixing tank;

the controlling the opening degree of the first electronic expansion valve according to the operating parameter comprises:

when the discharge temperature of the compressor exceeds a preset temperature, controlling the first electronic expansion valve to increase a preset opening degree in unit time;

when a degree of superheat is less than 0, controlling the first electronic expansion valve to decrease the preset opening degree in the unit time; wherein, the degree of superheat=the temperature in the mixing tank−a temperature corresponding to a saturation pressure;

when the liquid level in the mixing tank—a preset liquid level ≤0, controlling the first electronic expansion valve to decrease the preset opening degree in the unit time.

7. The method according to claim 5, wherein the controlling the opening degree of the first electronic expansion valve according to the operating parameter comprises:

controlling the opening degree of the first electronic expansion valve in a linkage mode according to a priority of the operating parameter; wherein the priority of the operating parameter from high to low is: the discharge temperature of the compressor, the liquid level in the mixing tank, the temperature in the mixing tank.

8. The method according to claim 5, wherein before the step of controlling the electromagnetic valve to switch on, the second electronic expansion valve to switch off, and controlling the opening degree of the first electronic expansion valve according to the operating parameter, the method further comprises:

when receiving a zero-load operation signal, reducing a load of the compressor to a minimum.

9. A water-cooled screw unit, comprising the load control device according to claim 1.

10. A non-transitory computer-readable storage medium, storing a computer program, wherein the program, when executed by a processor, implements the method according to claim 2.

* * * * *